United States Patent [19]

Collot et al.

[11] Patent Number: 4,797,797

[45] Date of Patent: Jan. 10, 1989

[54] DIPPED HEADLAMP FOR MOTOR VEHICLES

[75] Inventors: Pierre Collot, Pantin; Norbert Brun, Bobigny, both of France

[73] Assignee: Cibie Projecteurs, France

[21] Appl. No.: 67,432

[22] Filed: Jun. 25, 1987

Related U.S. Application Data

[63] Continuation of Ser. No. 755,070, Jul. 15, 1985, abandoned.

[30] Foreign Application Priority Data

Jun. 7, 1985 [FR] France ..... 85 08655

[51] Int. Cl.[4] ..... F21V 7/00

[52] U.S. Cl. ..... 362/348; 362/309; 362/350

[58] Field of Search ..... 362/61, 80, 83, 297, 362/307, 308, 309, 310, 311, 347, 348, 446, 350

[56] References Cited

U.S. PATENT DOCUMENTS

| | | | |
|---|---|---|---|
| 1,566,590 | 12/1925 | Godley | 362/348 |
| 1,686,543 | 10/1928 | Wood | 362/309 |
| 3,858,040 | 12/1974 | Ricard | 362/309 |
| 4,238,817 | 12/1980 | Fratty | 362/309 |
| 4,530,042 | 7/1985 | Cibie et al. | 362/309 |

*Primary Examiner*—Samuel Scott
*Assistant Examiner*—Noah Kamen
*Attorney, Agent, or Firm*—McCormick, Paulding & Huber

[57] ABSTRACT

A dipped headlamp for motor vehicles comprising a bulb, a reflector and closure glass placed in front of the reflector and bulb. The bulb is an axial filament bulb without a masking cup. The reflector comprises a reflecting surface without any discontinuity and suitable for forming images of the filament with all points of the image being situated below a horizontal plane. Correction means for angularly displacing said images upwardly to raise them to level of the two horizontal masking half-planes comprise prisms in the closure glass or side sections of the reflector which are tilted upwardly.

5 Claims, 3 Drawing Sheets

DIPPED HEADLAMP FOR MOTOR VEHICLES

This is a continuation of co-pending application Ser. No. 755,070 filed on July 15, 1985, now abandoned.

The present invention relates to a motor vehicle dipped headlamp, in which the light beam is masked above two horizontal half planes set at different heights.

BACKGROUND OF THE INVENTION

This type of masking, as described in U.S. Pat. No. 3,858,040, herein incorporated by reference and made a part hereof, is specifically adapted to the lighting standards in force in the USA, as defined, for example, by standard SAE J 579 C.

More precisely, the contour of the mask is defined by two horizontal half-planes, with the right-hand half-plane being on the same level horizontally as the axis of the headlamp and with the left-hand half-plane being displaced below the horizontal by about 1.5%.

Beams meeting these standards are generally designed using a headlamp having a bulb with a transverse filament which cooperates with a parabolic reflector of relatively long focal length so as to reduce the width of the beam and consequently minimize the extra thickness required for the deflecting prisms in the closure glass.

headlamps have also been proposed using an axial filament. In this case, the filament is focused in a parabolic reflector which is downwardly inclined in order to reduce the deflection required from the prisms in the glass, in other words, in order to reduce the maximum thickness of the glass.

The above-mentioned US Pat. No. 3,858,040 describes examples of both of these types of headlamps.

However, in both cases it is necessary to use a parabolic reflector having a relatively long focal length (about 29 mm to 32 mm) which therefore recovers relatively little flux.

A short focal length would give rise to excessively large images which would make it impossible to obtain the desired beam, unless high deflection prisms were used in the closure glass. The later is incompatible with the practicalities of molding (in particular when the closure glass is made of glass rather than plastic). In addition, high deflection prisms prevent a satisfactorily sharp cutoff due to the light dispersion which occurs because of the very marked relief of the glass.

Proposals have also been made to provide a reflector based on two half-paraboloids in order to reduce the unwanted side-effects due to the prisms in the glass. However, the reflector in such a headlamp has a surface discontinuity where the two half paraboloids meet. A reflector manufactured according to such teaching is difficult to make, and, in practice, the reflector will always be imprefect where the two half-paraboloids meet, thereby giving rise to light rays projected above the masking limit.

Preferred embodiments of the present invention provide dipped headlamps which remedy the above drawbacks and enable maximum recovery of the light flux emitted by the filament of the bulb.

SUMMARY OF THE INVENTION

The proposed dipped headlamp comprises, in conventional manner, a bulb, a reflector, and a closure glass in front of the reflector, together with means for masking the light beam above two horizontal half-planes at different horizontal levels.

According to the invention the headlamp has the following characteristics:

The bulb is an axial filament bulb without a masking cup.

The reflector comprises a deflecting surface without any discontinuity and suitable for forming images of the filament with all points of the image below a horizontal plane; and Correction means are provided for angularly displacing said images upwardly to raise them to the level of the two horizontal masking half-planes.

In a first embodiment, the reflector is preferably inclined downwardly at an angle representative of the angular displacement of the left cutoff mask relative to the horizontal in a United States beam so as to begin left hand side masking. It is also inclined to the right by an angle corresponding to about half the angular extent of the concentration images from the sides of the reflector. The concentration images are raised to the horizontal level by the closure glass.

In another embodiment, the correction means comprise two lateral surfaces adjoining the reflector surface having the same equation as an extension thereof (taking account of the upward tilt) with the re-distributing closure glass then deflecting slightly in the vertical direction.

Preferably, in either case, the deflecting surface is suitable for forming images of the filament such that the highest point of each image is situated on a horizontal plane.

BRIEF DESCRIPTION OF THE DRAWINGS

Embodiments of the invention are described by way of example with reference to the accompanying drawings, in which.

DETAILED DESCRIPTION

Figure 1:
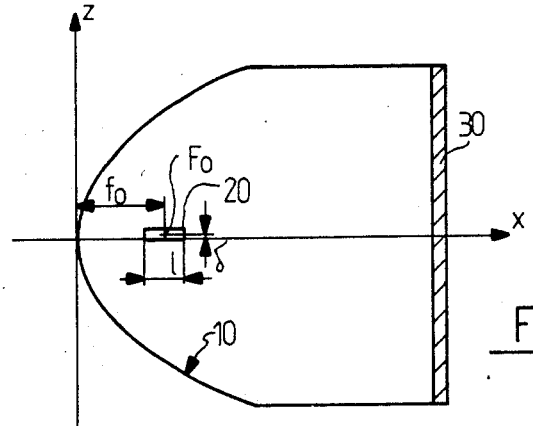
FIG. 1 is a diagrammatic section through a headlamp in accordance with the invention.
Figure 2:
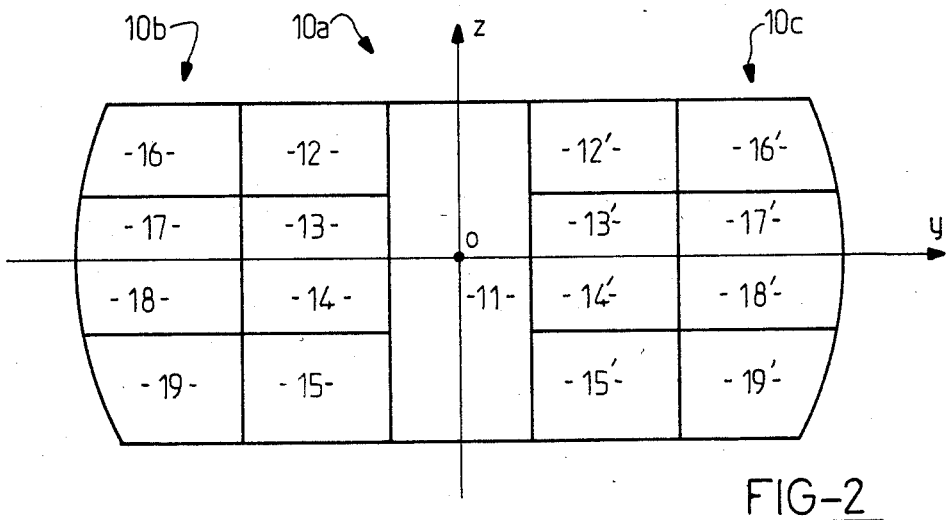
FIG. 2 is a front view of the reflector of the FIG. 1 headlamp.

A headlamp in accordance with the invention as shown diagrammatically in FIG. 1 comprises a reflector 10, an axial filament bulb 20, and a re-distributing glass 30 which closes the headlamp.

The reflective surface is without discontinuity, and is selected in such a manner as to form images of the filament such that all the points of the images are below a horizontal plane and, advantageously, the tops of the images are aligned with said horizontal plane.

The term "without discontinuity" is used to designate continuity which is provided to the second order at any point on the surface, i.e. such that the radius of curvature and the position of the center of curvature always vary continuously. In practice, such a disposition makes it possible to provide real surfaces which correspond very closely to the corresponding theoretical surfaces, thereby avoiding the specific defects of the offset "paraboloid" system as described above. Second order continuity ensures that the reflector is theoretically capable of being made by stamping.

Theoretical calculations show that a surface defined by the following equation has the required properties:

$$x = \frac{y^2}{4f_0} + \frac{z^2}{4\left[f_0 - \frac{z}{|z|} \times \frac{l}{\left(1 + \frac{y^2}{4f_0^2}\right)}\right]}$$

where:

l=the filament half-length;

$f_0$=the distance between the center of the filament and the co-ordinate origin; and

0x is the axis of the reflector, and the plane x0y is a substantially horizontal plane, i.e. horizontal when the reflector axis is horizontal.

Such a surface has been defined in U.S. Pat. No. 4,530,042, assigned to the assignee of the parent application, herein incorporated by reference and made a part hereof, to may be hade for further detail.

Preferably, when such a surface is used, the radial distance between the surface of the reflector and the surface defined by the equation should not exceed 0.15 mm.

Also, preferably, the normal distance in a vertical plane passing through the co-ordinate origin between the curve followed by the reflector surface and the corresponding least squares parabola should not exceed 0.3 mm (where the term "least squares parabola" is explained in the above-mentioned U.S. Patent).

Also, preferably, the distance between the axis and the light-emitting surface should not exceed 25% of the diameter of the filament in one direction or the other.

Also, preferably, the filament is axially centered relative to the point having the co-ordinates ($f_O$, O, O) to within 10% of the length of the filament in one direction or the other.

FIGS. 4 to 11 and FIG. 12 show the illumination provided by regions 12 to 19 and 11 respectively of a bare reflector as defined above and having its axis 0x horizontal.

The regions 12' to 19' produce illumination which is symmetrical about the vertical vv' to the illumination produced by the regions 12 to 19, respectively.

In these figures, the outermost curve corresponds to 100 condelas of illumination, the next curve corresponds to 1000 candelas and the following curves correspond to 2000, 4000, . . . candelas.

The use of a reflector defined in this manner is not, of itself, sufficient to obtain the desired beam masking (unlike the two prior documents mentioned above).

Thus, instead of keeping the reflector axis 0x horizontal (as was the case for the above-mentioned documents) the filament and reflector assembly is tilted downwardly and to the right toward the point of maximum concentration as defined by the above-mentioned standard SAE J 579 C.

It is then necessary to bring the images produced by the side regions of the reflector (regions 16 to 19 and 16' to 19') to the levels of the two masking half-planes by appropriate correction means.

Figure 3:
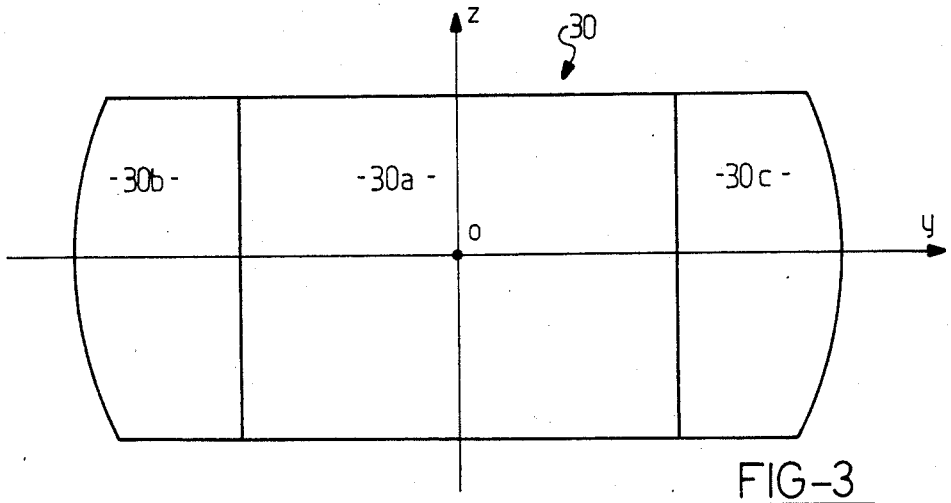
FIG. 3 is a front view of the closure glass of the FIG. 1 headlamp.
Figure 4:
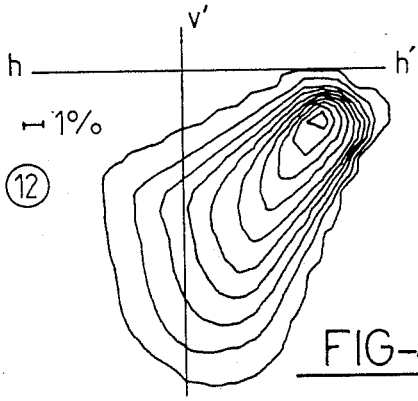
FIGS. 4 to 11 are isolux curves taken from a standardization screen and produced by the zones respectively designated 12 to 19 on FIG. 2.
Figure 8:
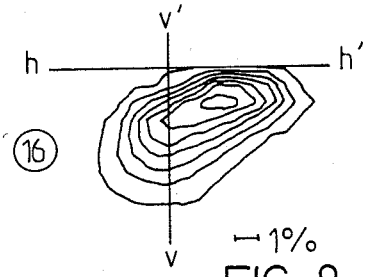
Figure 5:
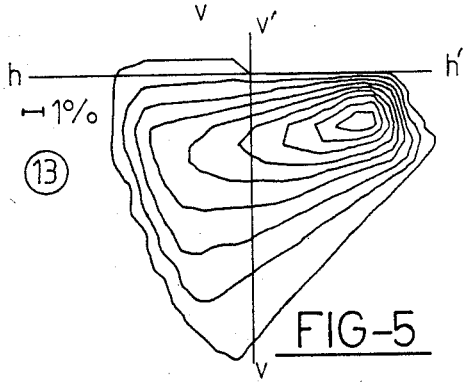
Figure 9:
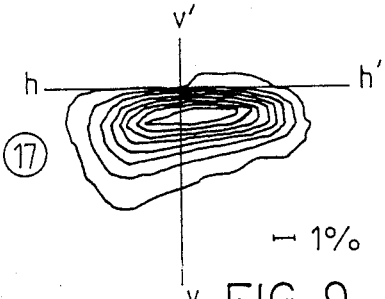
Figure 6:
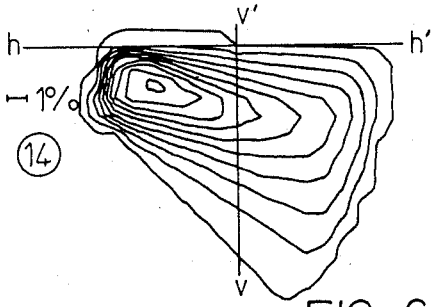
Figure 10:
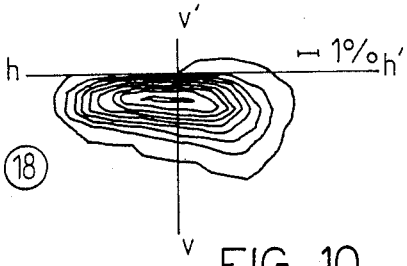
Figure 7:
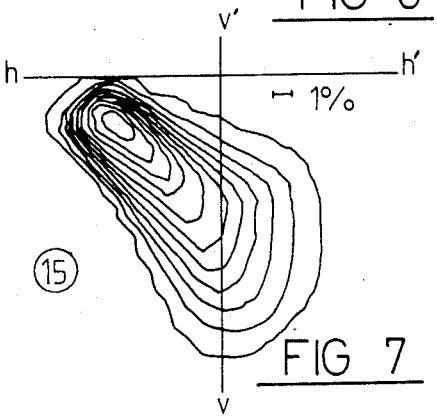
Figure 11:
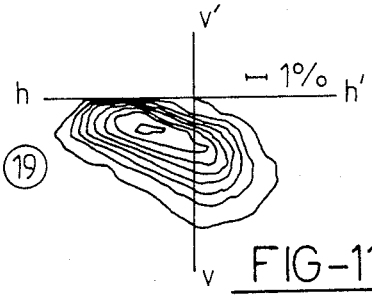
Figure 12:
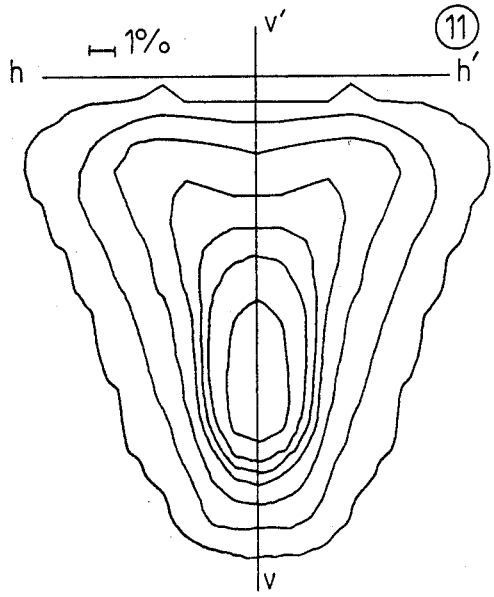

In a first embodiment these correction means are constituted by prisms formed in corresponding regions **30*b* and 30*c* of the closure glass (see FIG. 3), which regions are provided with 1° to 3° prisms. The central region 30*a*** of the closure glass may be striped in conventional manner in order to obtain the desired comfort and increased width for the light beam.

Figure 13:
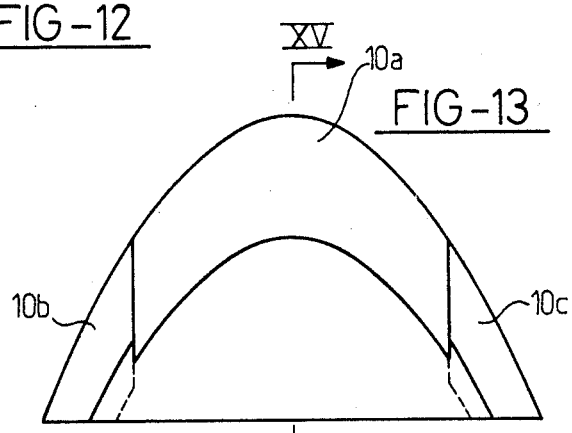
FIGS. 13 to 15 are respectively a plane view in section, a front view, and an elevation view on a line XV-XV of a reflector for a second embodiment of the invention.
Figure 15:
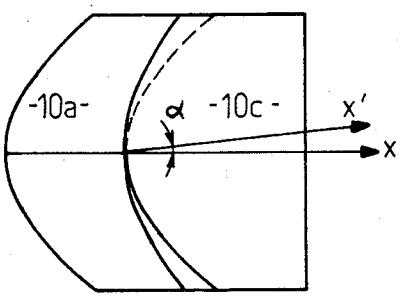
Figure 14:
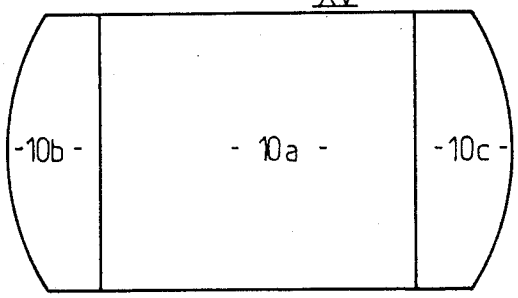

In a second embodiment, shown in FIGS. 13 to 15, the surface **10*a* of the reflector is extended by two side faces 10*b* and 10*c* having the same equation, but at a slightly different angle (as can be seen in FIG. 15**), which angle is also about 1° to 3°.

In other words, the reflector of the previous embodiment is modified while retaining the same surface equation except insofar as the portion of the reflector surface corresponding to the region 16 to 19 on one side and 16' to 19' on the other side are very slightly tilted upwardly. In this embodiment the regions **30*b* and 30*c*** of the closure glass need not have any prisms, or may be very slightly prismatic. Thus, due to the multiplicity of horizontal reliefs of the prisms in the preceding case is eliminated.

In either embodiment, a headlamp in accordance with the invention is capable of collecting a considerably greater quantity of light flux than that which is collected by a paraboloid in a conventionally designed axial filament headlamp, since such headlamps are difficult to design with a focal length of less than 29 mm.

In contrast, a headlamp in accordance with the present invention may use a very small basic focal length $f_0$, e.g. 22.5 mm, thereby making it possible to provide a headlamp which is generally rectangular in shape, symmetrical, and 70 mm high by 150 mm wide. Conventional headlamps are usually limited to a minimum focal length of 31.75 mm and a height of not less than 100 mm.

The light flux gain relative to conventional headlamps is about 30%.

We claim:

1. A dipped headlamp for motor vehicles comprising a bulb and a reflector having a reference axis and a closure glass placed in front of the bulb ad the eflector, and adapted to create a light beam under a cut-off defined in a standardized vertical transverse screen by two horizontal half-lines at different heights, and on the opposite sides of a vertical center line, the left-hand half-line being at the lower level;

said bulb being an axial filament bulb with its light-emitting surface completely exposed, said reflector comprising a reflecting surface without any discontinuity and forming on said screen images of the filament such that substantially all points of said images are below a horizontal line contained in said screen and intersecting the reflector axis, and the side portions of the reflector forming images of the filament smaller than the center portion thereof, the axis of the filament and the axis of the reflector being both inclined downwardly with respect to the horizontal in such manner that said horizontal line is at the same level as the lower half-line of the cut-off, the axis of the filament and the axis of the reflector being further inclined to the right at an angle corresponding to about one half of the horizontal extent of said concentration images, and the headlamp further comprising correction means associated with said side portions of said reflector for angularly displacing said concentration images upwardly to the level of the right-hand upper half-line.

2. A headlamp according to claim 1 wherein said upper half-line is at the level of a horizontal headlamp axis and the lower half-line is tilted below said horizontal headlamp axis by about 1.5%.

3. A headlamp according to claim 1 wherein the correction means comprise said side portions of the reflector being upwardly tilted relative to the remainder of the reflector, the closure glass being substantially smooth.

4. A headlamp according to claim 1 wherein said filament images formed by the reflector each have their highest point substantially on said horizontal line intersecting the reflector axis.

5. A headlamp according to claim 4 wherein: the filament is offset upwardly in a direction perpendicular to said reflector axis by an amount (δ) such that its light-emitting surface is substantially tangential to the axis (0x) and the surface of the central portion of the reflector is defined by the equation:

$$x = \frac{y^2}{4f_0} + \frac{z^2}{4\left[f_0 - \frac{z}{|z|} \cdot \frac{l}{\left(1 + \frac{y^2}{4f_0^2}\right)}\right]}$$

where:

l = the filament half-length, $f_0$ = the distance between the center of the filament and the co-ordinate origin; and Ox is the axis of the reflector, and the plane x0y is a substantially horizontal plane.

* * * * *